US006658985B2

(12) United States Patent
Aumont et al.

(10) Patent No.: US 6,658,985 B2
(45) Date of Patent: Dec. 9, 2003

(54) SITE HEAD WITH INTEGRATED LASER DESIGNATOR FOR USE IN AIRCRAFT SUCH AS A ROTORCRAFT

(75) Inventors: Gérard Aumont, Jody Ew (FR); Bernard Fontaine, Villebon/Yvette (FR)

(73) Assignee: MBDA France, Paris (FR)

( * ) Notice: Subject to any disclaimer, the term of this patent is extended or adjusted under 35 U.S.C. 154(b) by 28 days.

(21) Appl. No.: 10/160,832

(22) Filed: May 30, 2002

(65) Prior Publication Data

US 2003/0010864 A1 Jan. 16, 2003

(30) Foreign Application Priority Data

May 30, 2001 (FR) ..... 01 07056

(51) Int. Cl.[7] ..... F41G 1/32

(52) U.S. Cl. ..... 89/41.06; 89/41.21; 244/3.16; 33/229

(58) Field of Search ..... 89/41.06, 41.21, 89/41.01, 41.02, 41.19; 244/3.13, 3.16; 33/229

(56) References Cited

U.S. PATENT DOCUMENTS

| | | | | |
|---|---|---|---|---|
| 5,007,736 A | * | 4/1991 | Daniel et al. | 356/139.08 |
| 5,231,401 A | * | 7/1993 | Kaman et al. | 342/55 |
| 5,806,789 A | * | 9/1998 | Boulware et al. | 244/1 R |
| 6,422,508 B1 | * | 7/2002 | Barnes | 244/3.16 |

* cited by examiner

*Primary Examiner*—J. Woodrow Eldred

(57) ABSTRACT

Sight head with integrated laser designator for use in an aircraft such as a rotorcraft.

The laser designator (32) is integrated into a zone of a main external assembly of the pod (14) of the sight head (12), enclosed externally in an existing fairing (34). It comprises a laser transmitter (36), a power supply (38) and a radio receiver (40). The laser transmitter (36) is fitted to the site head structure using adjusting screws (46) which allows the alignment to be modified.

5 Claims, 3 Drawing Sheets

SITE HEAD WITH INTEGRATED LASER DESIGNATOR FOR USE IN AIRCRAFT SUCH AS A ROTORCRAFT

TECHNICAL BACKGROUND

This invention relates to a sight head equipping an aircraft such as a rotorcraft. More precisely, the object of the invention is a sight head fitted with an integrated laser designator for the illumination of a target using a laser beam radiating in the visible or near infra-red spectrum.

The invention applies in particular to a sight head of a helicopter weapon fire control system.

STATE OF THE TECHONLOGY

It is known to fit military helicopters with a weapon fire control system equipped with a sight head. More precisely, the sight head comprises a pod the major part of which is generally located above the roof of the helicopter fuselage. An eyepiece carrier arm extends the sight head to the inside of the fuselage.

Under certain conditions of use, it is necessary to illuminate the target with a laser beam. Depending on whether the operator observes the target with his naked eye or using night vision goggles, a laser beam transmitting in the visible or near infrared spectrum is used.

Currently, the illumination of the target is performed using a device known as a 'laser designator'. More precisely, this device is hand held outside the helicopter. In effect, the fuselage of the helicopter creates a strong attenuation of the laser frequencies and would cause harmful internal reflections if the laser pointer were to be used inside the helicopter.

Because of their manual characteristics and the need for deployment outside the helicopter, the existing laser designators do not allow precise sighting. The usability is thus reduced.

FR-A-2 640 037 relates to a sight mast for a helicopter fitted with a telemeter or laser photoelectric shutter which looks through the blades of the rotor. This arrangement allows the motion of the blade during the alignment phase between the sight and the seeker head of a missile to be taken into account.

DESCRIPTION OF THE INVENTION

Precisely, the object of the invention is a sight head equipped with an integrated laser designator to allow an optical pointing accuracy and an optimum usability, without degrading the inherent characteristics of the sight head.

More precisely, the invention refers to a sight head for a rotorcraft, comprising a pod in which at least a part is available mounted externally to the rotorcraft fuselage, characterized by the integration of a laser designator in the said part of the pod.

Preferably, the part of the pod installed externally to the fuselage has the sight head covered by an existing aerodynamic fairing. Thus, the aerodynamic characteristics of the sight head are not modified by the installation of the laser designator.

Advantageously, the laser designator comprises a laser transmitter and a means of adjusting its alignment within the said pod, allowing the laser beam from the laser designator to be aligned parallel to a sight axis of the sight head. It is thus possible to accurately adjust the parallelism of the laser beam with the axis of the sight head.

In this case, the preferred alignment method consists of three adjustment screws equally spaced around the laser transmitter.

Furthermore, the laser designator also comprises its own power supply for the laser transmitter and a radio receiver, required to start and stop the laser emission.

BRIEF DESCRIPTION OF THE FIGURES

This document describes as an illustrative example, which is non-exhaustive, a preferred way of implementing the design of the invention, by reference to the drawings at annex in which.

DETAILED DESCRIPTION OF A PREFERRED EMBODIMENT

Figure 1:
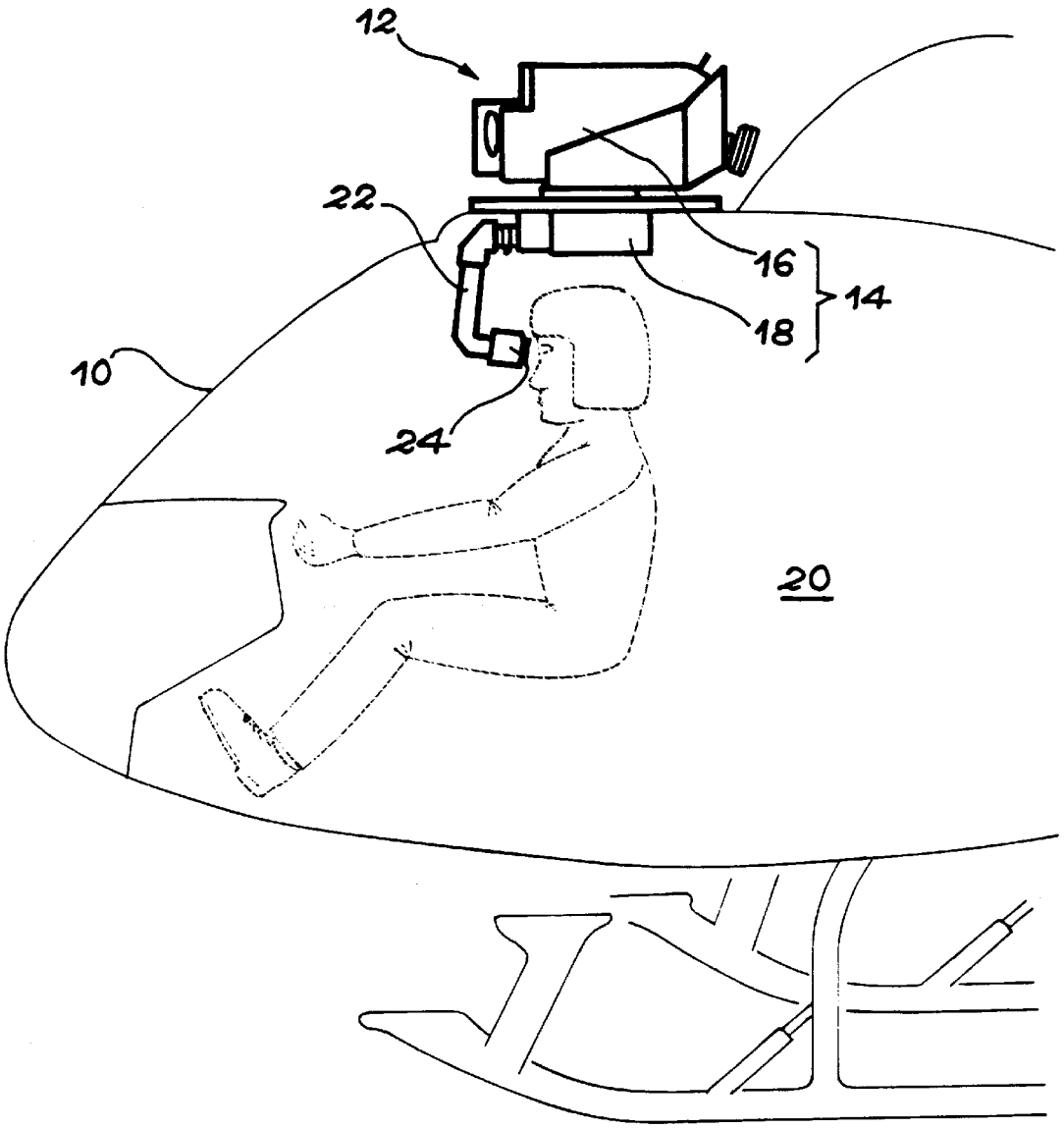
FIG. 1 is a side view, which represents schematically the forward part of a helicopter fitted with a sight head and integrating a laser designator in accordance with the invention.

In FIG. 1, the front part of the helicopter has been shown schematically. This comprises a fuselage 10 where the roof supports a sight head 12 of a weapon fire control system (not shown).

The sight head 12 comprises a pod 14 of which a main assembly 16 is situated above the roof of the fuselage 10, externally to the helicopter. Another part 18 of the pod 14 is located inside the cockpit 20 of the helicopter. An eyepiece carrier arm 22 fitted with an eyepiece 24 is fitted to the part 18 of the pod 14, in order to allow an observer inside the cockpit 20 to utilise the sight head 12.

The parts 16 and 18 of the pod 14 and the eyepiece carrier arm 22 are used to house different optical components (not shown) allowing an observer looking through the eyepiece 24 to view a scene along the sight axis 26. Only the output lens 28 fitted on this axis 26 can be seen in FIG. 2.

Figure 2:
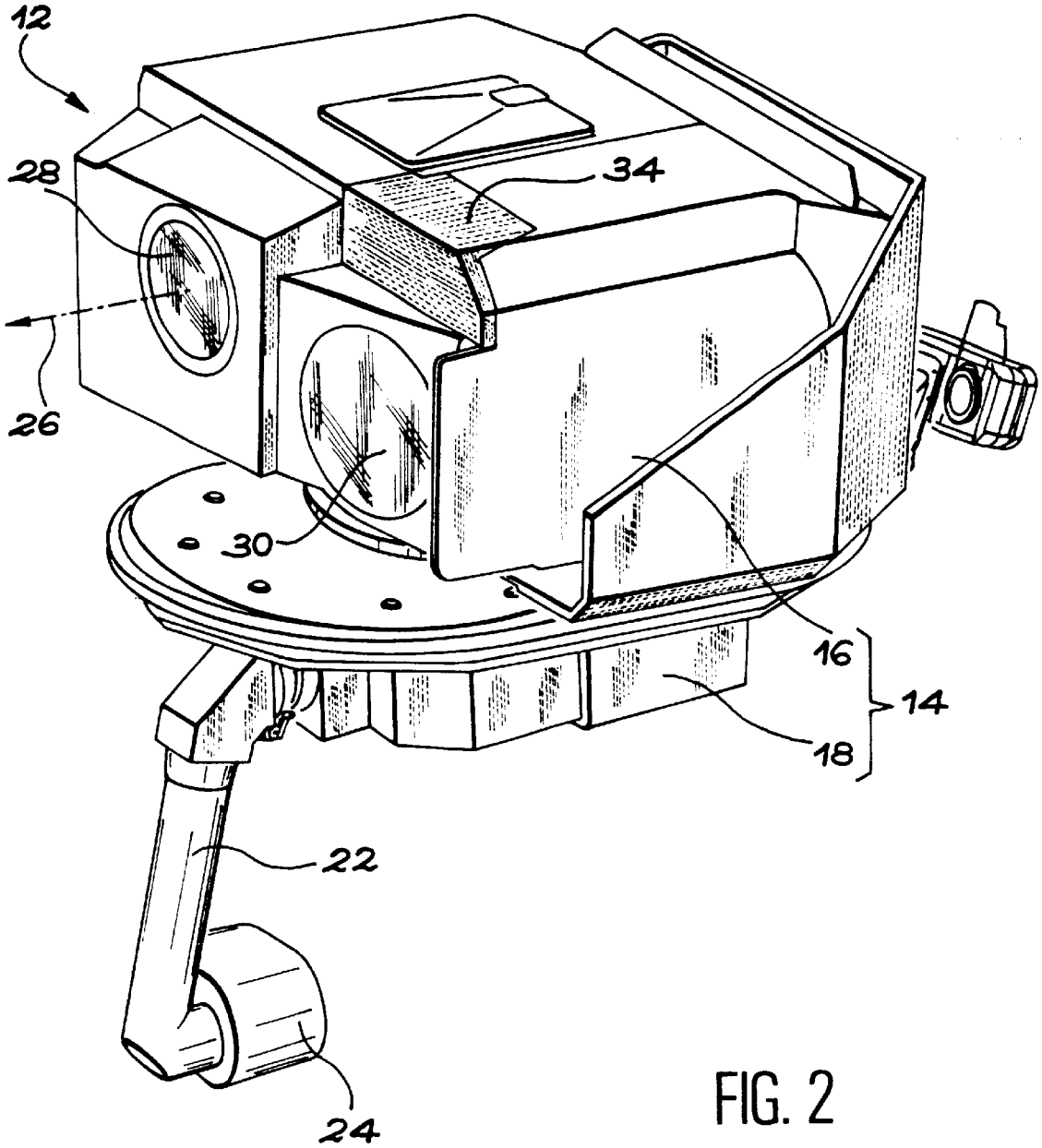
FIG. 2 shows a perspective schematic view of the sight head in FIG. 1.

In the design configuration shown in FIG. 2, the main assembly 16 of the pod 14 also allows a camera 30 to be fitted.

In accordance with the invention, a laser designator is also fitted inside the main assembly 16 of the pod 14.

Figure 3:
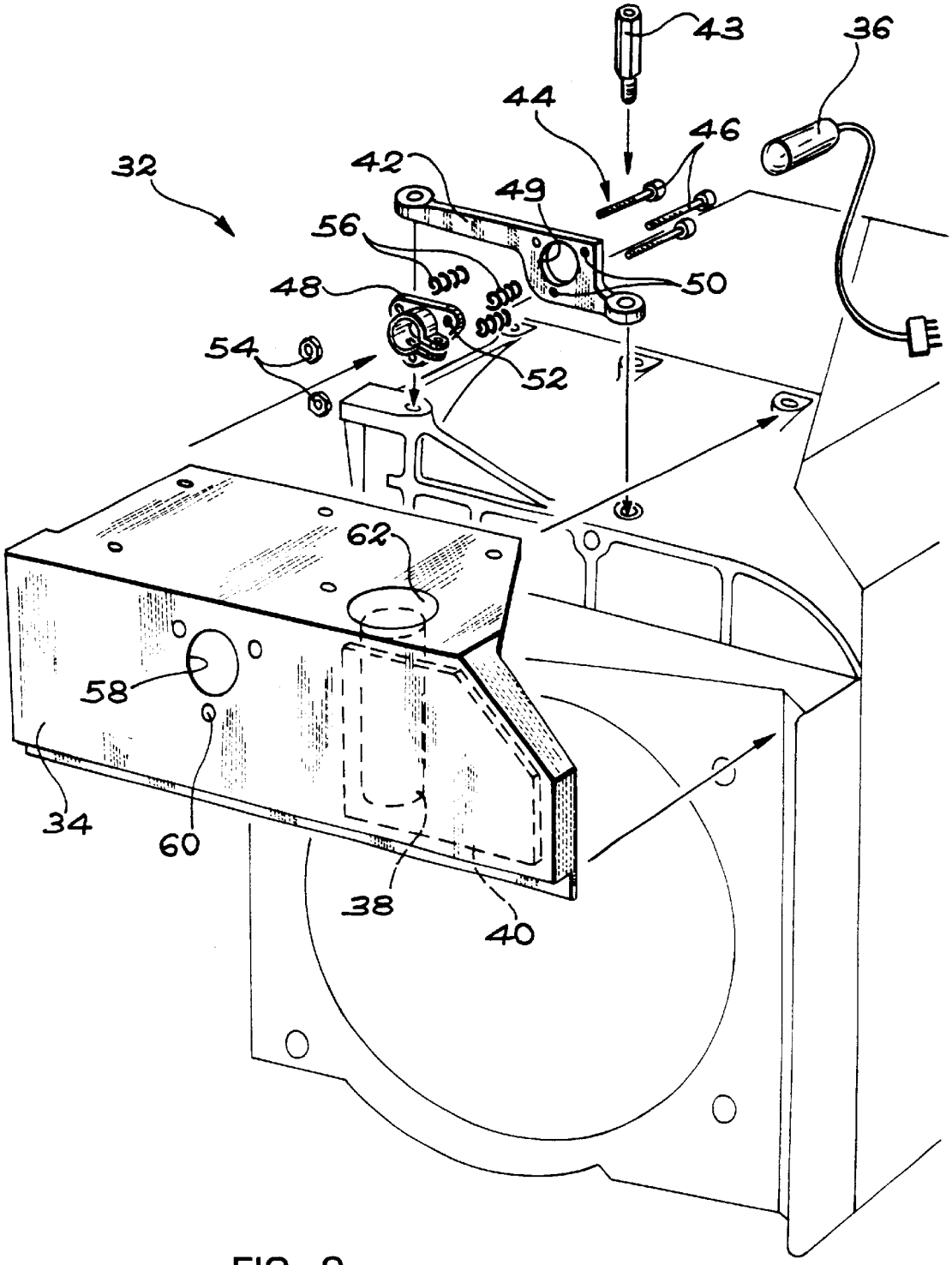
FIG. 3 is an exploded perspective view of the laser designator fitted to the site head of FIG. 2.

More precisely and as illustrated in particular in FIG. 3, the laser designator 32 is installed in a zone within the main assembly 16 of the pod 14, and the externally mounted portion covered by an existing aerodynamic fairing 34. In the design configuration represented in the figures, the zone which houses the laser designator 32 is situated above the camera 30. However, this zone can be sited in any other available appropriate location, depending upon the specific characteristics of the sight head installation arrangements.

Generally, the zone in which the laser designator 32 is fitted is chosen taking account of a certain number of criteria, such as the level of comfort for the operator, the availability of adequate installation space to accept the different assemblies of the laser designator, the existence of adequate mounting seats to ensure a rigid installation, the ease of maintenance access and the conformance with the external envelope geometry of the sight head.

The laser designator 32 essentially comprises a laser transmitter 36, a stand-alone power supply 38 for the transmitter and a radio receiver 40.

The laser transmitter 36 is, for example, a laser emitting diode able to produce a laser beam in the visible or near infra red spectrum, depending on whether the observer is viewing a scene with the naked eye or using night vision goggles.

The laser transmitter 36 is fitted to a reference support unit 42, fitted inside the assembly 16 of the pod 14, for example using a screw 43. More precisely, the laser transmitter 36 is fitted to the support unit 42 using an angular adjustment arrangement 44. The said adjustment arrangements are used to allow accurate adjustment of the parallelism of the laser beam emitted by the laser transmitter 36 with respect to the sight axis 26 of the sight head 12.

In the preferred embodiment of the invention shown in FIG. 3, the angular adjustment arrangements 44 comprises three adjusting screws 46, in line with the axis of the laser transmitter 36 and equally spaced around this axis.

More precisely, a forward part of the laser transmitter 36 is attached to a plate 48, at the front of the support unit 42, and passes through an opening 49 machined in the said support unit. Furthermore the screws 46 pass freely through the holes 50 and 52 formed respectively in the support unit 42 and the plate 48, and they are screwed into the nuts 54, at the front of the plate 48. Helical compression springs 56, fitted to each of the screws 46 between the support unit 42 and the plate 48, ensure that the two parts remain permanently separated from each other.

When the aerodynamic fairing 34 is in place, i.e. when fitted to the main assembly 16 of the pod 14, for example using a screw (not shown), the forward end of the laser transmitter 36 is opposite to an opening 58 made in the said fairing and each of the nuts 54 is then opposite a hole 60 drilled in the fairing 34.

It is thus possible to adjust alignment of the beam emitted by the laser with respect to the sight axis 26, by introducing a tool such as a spanner through the holes 60, in order to access the nuts 54. In fact, by rotating one of the screws 54 in one or other direction, using the appropriate tool, has the effect of compressing or lengthening the spring 56 held captive on the screw 46 by the nut. Thus it is possible to adjust the distance between the plate 48 and the support unit 42, with respect to the screw 46 considered.

The power supply 38 is, for example, a dry cell or electrical supply battery. It is located beneath an opening in the fairing 34, usually closed by a hatch 62. The power supply 38 is used to supply the power to the laser transmitter 36 as well as the radio receiver 40.

Finally, the radio receiver 40 is connected electrically to the laser transmitter 36 and the power supply 38 in order to allow the laser transmitter 36 to be switched on and off.

Of course, the invention is not limited to the design configuration, which has been described for example purposes. Hence, as has already been stated, the laser designator may be installed in a different design of sight head and in a different location to that described, and still remain within the framework of the invention.

What is claimed is:

1. Sight head of a rotorcraft weapon fire control system, said sight head comprising a main pod assembly located at the outside of a helicopter, another pod part located inside said helicopter, and an eyepiece carrier arm fitted to said another pod part in order to allow an observer inside said helicopter to utilize said sight head, wherein a laser designator is integrated into said main pod assembly of the sight head.

2. Sight head according to claim 1, wherein said main pod assembly is enclosed externally in an existing sight head aerodynamic fairing.

3. Sight head according to claim 1, wherein said laser designator comprises a laser transmitter and an angular adjustment arrangement within said main pod assembly, allowing a laser beam emitted by said laser designator to be aligned parallel to a sight axis of the sight head.

4. Sight head according to claim 3, wherein said angular adjustment arrangement comprises three adjuster screws evenly spaces around said laser transmitter.

5. Sight head for a rotorcraft, comprising a pod an assembly at least of which is able to be mounted externally to the fuselage of the rotorcraft, characterized by a laser designator an integrated into the sight head, in the said assembly of the pod, wherein the laser designator also comprises its own power supply for the laser transmitter and a radio receiver to permit the transmitter to be switched on and off.

* * * * *